US005306360A

United States Patent [19]

Bharti et al.

[11] Patent Number: 5,306,360

[45] Date of Patent: Apr. 26, 1994

[54] PROCESS FOR IMPROVING THE FATIGUE CRACK GROWTH RESISTANCE BY LASER BEAM

[76] Inventors: Arvind Bharti, D-45/10, Defence Laboratory Quarters, P.O. Kanchanbagh; Vikas K. Saxena, D-285/5, Defence Laboratory Quarters, P.O. Kanchanbagh, both of Hyderabad-500 258, India

[21] Appl. No.: 803,112

[22] Filed: Dec. 5, 1991

[51] Int. Cl.[5] ..... C22C 14/00; C21D 10/00

[52] U.S. Cl. ..... 148/525

[58] Field of Search ..... 148/525, 669; 420/903

[56] References Cited

U.S. PATENT DOCUMENTS

| | | | |
|---|---|---|---|
| 3,461,002 | 8/1969 | Koistinen | 148/903 |
| 3,650,846 | 3/1972 | Holland et al. | 148/903 |
| 4,122,240 | 10/1978 | Banas et al. | 148/403 |
| 4,212,900 | 7/1980 | Serlin | 148/525 |
| 4,239,556 | 12/1980 | Cline et al. | 148/903 |
| 4,401,477 | 8/1983 | Clauer et al. | 148/525 |
| 4,617,070 | 10/1986 | Amende et al. | 148/903 |
| 4,825,035 | 4/1989 | Moriyasu et al. | 148/903 |
| 4,909,859 | 3/1990 | Nazmy et al. | 148/525 |
| 5,073,212 | 12/1991 | Froehlich | 148/903 |

FOREIGN PATENT DOCUMENTS

| | | | |
|---|---|---|---|
| 2-310310 | 12/1990 | Japan | 148/903 |

*Primary Examiner*—Upendra Roy

*Attorney, Agent, or Firm*—Ostrolenk, Faber, Gerb & Soffen

[57] ABSTRACT

The present invention relates to a process for improving the fatigue crack growth resistance of $\alpha$-$\beta$ titanium alloys and the like alloys/metals which comprises in making a single laser trail on the sheet or component of alloy/metal with the a selected power and scan speed and with the focal spot being upto 200 $\mu$m above or below the treating surface. The width of the trail is measured so as to adjust a job manupulator to cause successive scans with an overlap of 5 to 50%. The component is covered by successive scanning under an inert gas at a pressure of 20–48 PSI.

9 Claims, 3 Drawing Sheets

FIG. 1a.
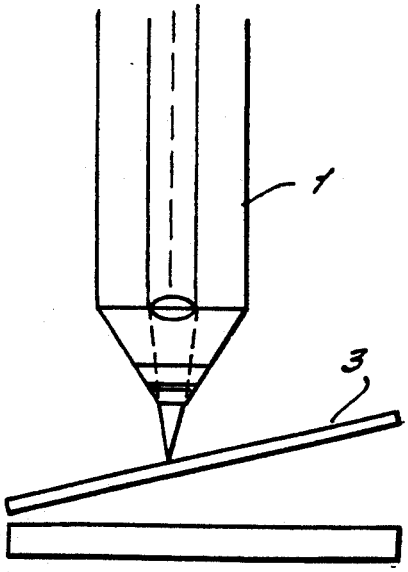
FIG. 1b.
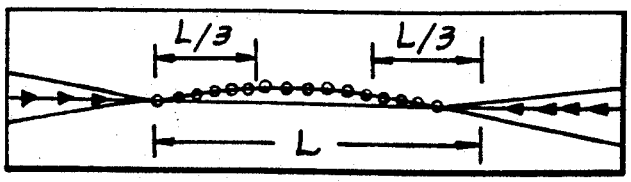
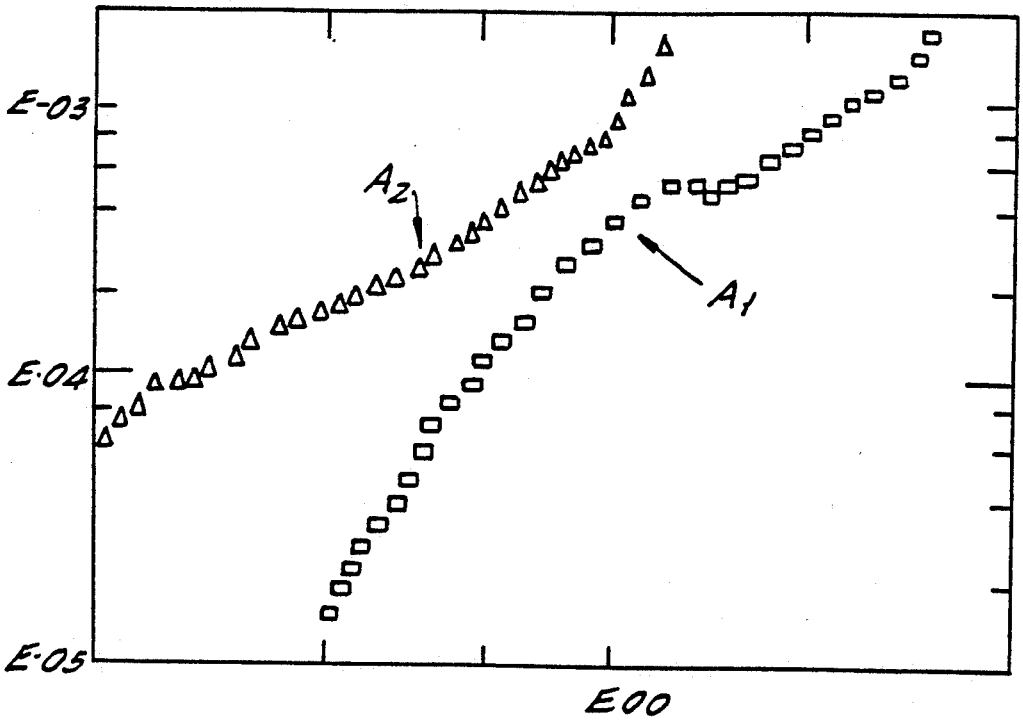
FIG. 2.

PROCESS FOR IMPROVING THE FATIGUE CRACK GROWTH RESISTANCE BY LASER BEAM

FIELD OF INVENTION

This invention relates to a process for improving the fatique crack growth of titanium alloys, pure iron and the like alloys/metals. Specifically, but without implying any limitation thereto, the process of the present invention has a beneficial application in improving the fatigue crack growth resistance of Ti-6.5 Al-3.5 Mo-1.9 Zr-0.23 Si alloy, alpha ($\alpha$) beta ($\beta$) titanium alloys, pure iron and other alloys/metals capable of retaining a metastable phase on rapid cooling.

PRIOR ART

Titanium alloys have useful applications as aerospace materials, and are employed in aerospace frames as structural material and also in turbine blades of jet engines. Due to the nature of loading in aerospace frames, the fatigue properties are of utmost importance. With the emerging use of non-metallic composites for aircraft wings and other structures, titanium alloys have assumed a greater importance as the joining structure for metallic and non-metallic components such as wings to the main body of the aircraft.

OBJECTS OF THE INVENTION

The present invention envisages a process for increasing the fatigue crack growth resistance of the $\alpha$-$\beta$ titanium alloys and other metallic materials hence increasing its utility and compatibility with the new generation non-metallic aerospace components.

Accordingly, a primary object of the present invention is to propose a novel process for improving the fatigue crack growth resistances of titanium alloys and the like alloys/metals.

SCOPE OF THE INVENTION

According to this invention there is provided a process for improving the fatigue crack growth resistance of titanium alloys and the like alloys/metals, comprising the steps of sand blasting the alloy component, determining the exact position and depth of focal spot of a laser beam, selecting the scanning speed for the available power of the laser beam, making a single laser trail on a sheet of the same material as component or the component itself with the selected power and scan speed such that focal spot is up to 200 $\mu$m above or below the surface to be treated, measuring the width of the trail so as to adjust a job manupulator in such a way that in successive scans there is an overlap of 5 to 50%, and covering the sand blasted surface of the component by successive scanning under a shield of any inert gas such as argon at a pressure of 20–48 PSI.

In accordance with the present invention a sheet or component of alloy/metal is sand blasted with alumina ($Al_2O_3$). Such a step of sand blasting is carried out prior to laser treatment in order to enhance the absorption of the laser energy on the surface to be treated. The focal spot of the laser beam has a variable diameter range depending on its location which is determined and also the scanning speed for the available power of the laser beam is selected for making a laser trail on said sheet/workpiece. The width of the trail is measured so as to provide a predetermined overlap in the successive scans depending upon the thickness of sheet/workpiece. During trail making, the distance between the nozzle and the workpiece is kept in the range of 10–25 mm.

BRIEF DESCRIPTION OF THE DRAWING

FIG. 1(*a*) shows a schematic set up for determining the focal spot;

FIG. 1(*b*) shows the shape of laser trail;

FIG. 2 shows characteristics of fatigue crack growth;

DETAILED DESCRIPTION OF THE INVENTION

Figure 3:
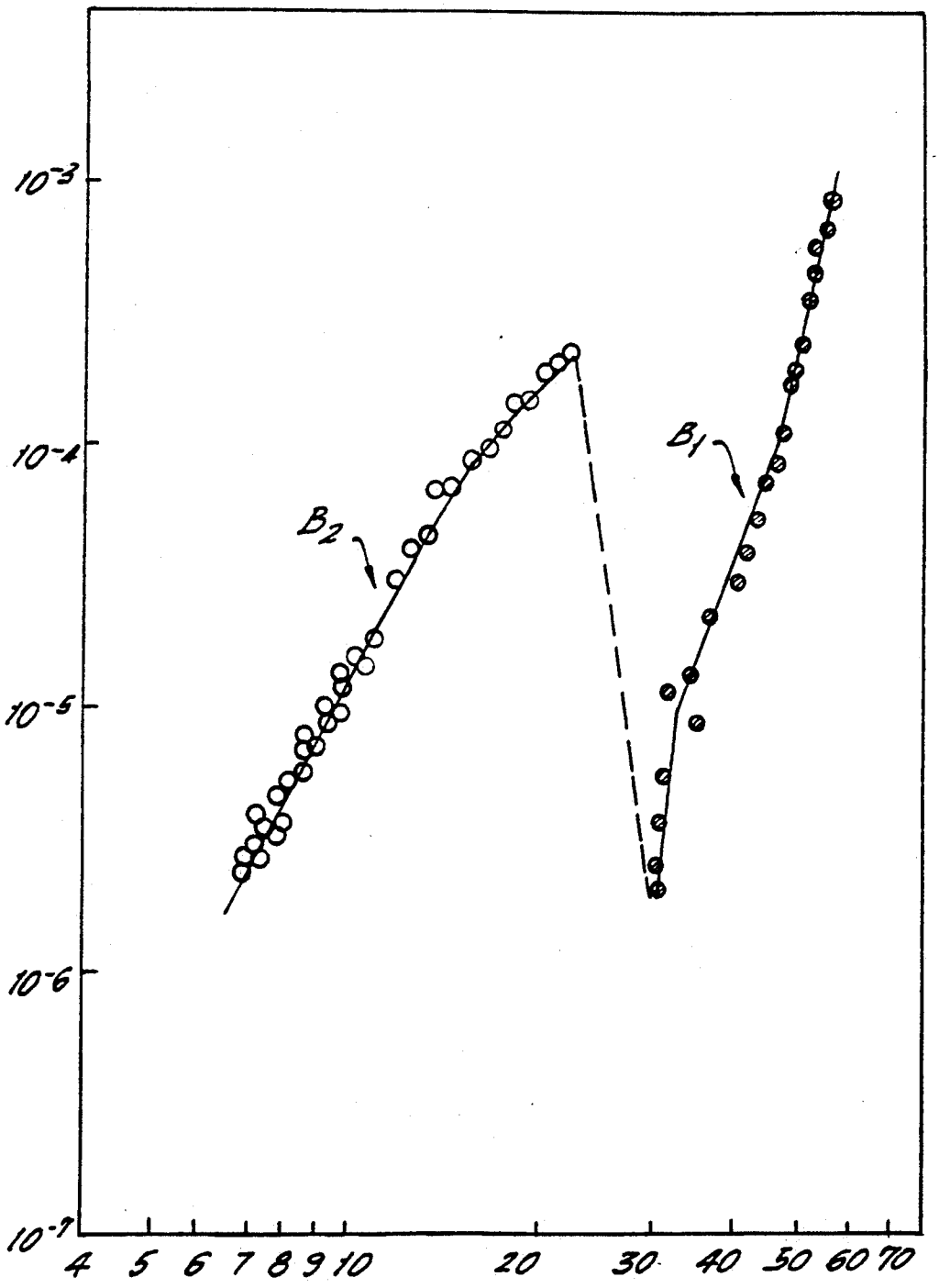
FIG. 3 shows characteristics of fatigue crack growth resistance.

The alloy/metal component or sheet is first sand blasted with alumina sand ($Al_2O_3$), for example of −100 mesh size, at a flow rate of 500 gm/min from a 6 mm nozzle at 60–90 PSI pressure, and then the characteristic diameter of focal spot of the $CO_2$ laser beam (to be used) is determined. The determination of the focal spot is in order to ascertain the precise location of the focal point of the invisible infrared $CO_2$ laser beam (10.6 $\mu$m wave length). Such a step is be repeated every time the laser has been tuned after maintanance. This is necessary as after every tuning, the mode configuration changes and the change affects the position of focal spot.

As shown schematically in FIG. 1(*a*) of the accompanying drawings a long plate 3, such as of 10" (inches) long of the same alloy or metal is moved under the focussed laser beam of 3 KW power (or any other power at which the component have to be treated) at 200 inches per minutes (IPM) velocity at any angle, preferably at an angle of 10°–15°, from horizontal plane. The laser trail is shown in FIG. 1(*b*). As shown in FIG. 1*b*, one third portion of the centre of trail, which have uniform melt width, is the region where the beam is most tightly focussed. The exact angle from the horizon and the location of plate with respect to laser beam helps in calculating depth of focus and the location of the spot with respect to tip of the nozzle.

A high purity argon gas shield is maintained over the component by means of a blowing nozzle having a shield gas pressure of for example 36 PSI for getting optimum result, the pressure being measured at the gas entrance of the nozzle. The improvement in fatigue crack growth resistance are achieved at a pressure of 20–48 PSI. The focal spot is kept between 200 $\mu$m above the alloy/metal sheet and 200 $\mu$m below the said sheet, while keeping a distance of 10–25 mm between nozzle tip and said sheet. Preferably, the focal spot is kept 50 um above the plate keeping clear distance of 18 mm between the nozzle tip and plate, a single trail is again created at the selected scan velocity a and laser power combination. The width of this trail is measured. During the processing of actual component, the component and/or the beam movement is controlled in such a way that 10% of the trails are overlapped in the successive passes, and linear velocity of the surface thus treated should be kept constant throughout the process. The overlapping is varied from 5 to 50% depending upon the thickness of the sheet or workpiece.

With the said conditions of the laser power, scan speed, shield gas pressure, distance from the tip of the blowing nozzle and sand blasted surface, the component surface can be covered by successive scanning with laser beam. The process of the present invention provides an increase in the fatigue crack growth resistance of bulk component by a factor ranging from 3 to 100 times.

EXAMPLE 1

6 mm thick sheet of an $\alpha$-$\beta$ titanium alloy was treated in above described conditions using 3 KW power and 40 IPM scan velocity on the surface of a CT (compact tension) sample (specification; width 50 mm, half-height to width ratio of 0.6 with L-T orientation). The CT sample thus prepared was precracked under cyclic loading and fatigue crack propagation behaviour was studied.

The result showed minimum of 400% (four times) improvement in fatigue crack growth resistance of the alloy.

EXAMPLE 2

The same alloy was subjected to the process of the present invention described in example No. 1 with a different scan velocity of 60 IPM at 3 KW power. The comparative results are shown in FIG. 2 and wherein graph $A_1$ is with respect to the laser treatment and graph $A_2$ is that by the conventional treatment and, wherein the abscissa is the range of stress intensity, $\Delta K$ its unit is mega paseal root meters, ($MPa\sqrt{m}$) and the ordinate is crack growth rate (da/dN), its unit being millimeters per cycle (mm/cycle).

EXAMPLE 3

A pure iron CT specimen was treated with the process of the present invention described in example no. 1 with scan speed of 40 IPM and power 3 KW. The comparative results are shown in FIG. 3 which shows up to 75 times improvement in fatigue crack growth resistance and wherein graph $B_1$ is the treated surface and $B_2$ is of the untreated surface. The abscissa and ordinate is the same as that of FIG. 2.

The considerable improvement reported in the examples 1 to 3 is due to the following reasons. Firstly, heating and cooling conditions which result due to localized heating by focused laser beam and self quenching results in retained metastable phases, a certain amount of epitaxy and residual stresses on the component surface. Secondly, there is a possibility of some atmospheric nitrogen getting first dissolved in the super hot liquid pool then diffusing to interstitial lattice sites. Such nitrogen may be present only in traces.

The interstitial nitrogen may also be a contributing factor to the improvement in the fatigue crack growth resistance.

The nitrogen pick up is indirectly controlled by shield gas pressure, shape of the nozzle and the clear distance between the nozzle and work piece. The shield gas pressure is measured at the inlet of the nozzle and its pressure at workpiece will be function of the distance of workpiece from the nozzle. If the distance between the workpiece and the nozzle is less than the specified distance, the process may increase the roughness of the treated surface. If the distance is larger than the specified, the process may lead to greater nitrogen and oxygen pickup on the treated surface, which may be unacceptable for same applications.

Figure 4:
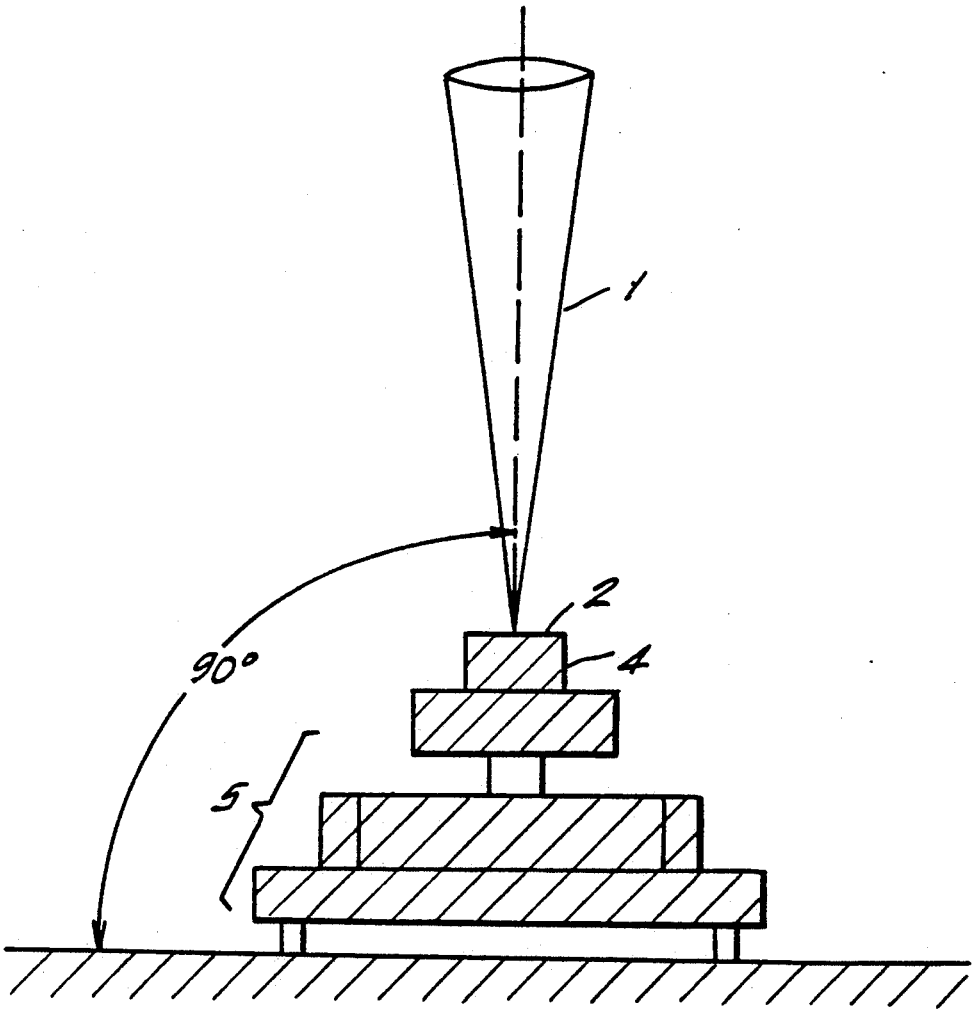
FIG. 4 shows the schematic position of the laser beam, workpiece and the work stations.

Configuration, that is the position of the work piece and the position of the focussed laser beam should be same as shown in FIG. 4 and that movement of the surface 2 to be treated should be parallel to the ground and laser beam 1, should reach it from top perpendicular to the ground.

Any variation in this configuration will affect the location of laser induced plasma and its interaction with incoming laser beam, which may result in variation in the reported properties. Laser induced plasma results from the excessive heating of the treated surface and its ambience. It contains substrate (surface being treated) ions and inert gas ions. When the laser beam is focussed from the top on the work piece, as in the present invention, the laser induced plasma will be in the beam path.

The plasma interacts with the laser beam in the following two ways:

i) It changes the spot size because refractive index of plasma is different than that of the air.

ii) Laser induced plasma absorbs the beam energy and then transfers the heat to the work piece. This results in delocalisation of the heat at the treated surface. Therefore, the net affect of laser induced plasma can be practically treated as defocussing of the laser beam.

The second affect, namely absorption of laser energy, dominates. Nitrogen pickup has been described as a possibility, and the source of which can be explained as follows. When the inert shield gas flows out of the nozzle, it expands and flows in complicated convection currents. The possibility of sucking in atmosphere (which contains 80% nitrogen) cannot be ruled out. The atmospheric gases (mainly nitrogen) sucked by inert gas will be present in the shield gas covering the treated surface, which can be picked up by the surface being treated. Such gases will be present in trace quantities and will affect the fatigue crack growth resistance, and, therefore, any change in shield gas pressure and distance between the work piece and nozzle will affect the improvements.

In FIG. 4 orientation of the component 4 to be glazed is shown with respect of laser on a work station 5.

We claim:

1. A process for improving the fatigue crack growth resistance of a component comprising $\alpha$-$\beta$ titanium alloys, pure iron and other alloys and metals capable of retaining a metastable phase on rapid cooling comprising the steps of sand blasting the component, determining the exact position and depth of focal spot of a laser beam, selecting a scanning speed for the available power of the laser beam, making a single laser trail on the component with the selected power and scan speed such that focal spot is up to 200 $\mu$m above or below the surface to be treated, measuring the width of the trail, successively scanning the component while adjusting successive scans such that there is an overlap of 5 to 50%, wherein the covering of the sand blasted surface of the component by successive scanning is effected under a shield of an inert gas at a pressure of 20–48 PSI.

2. A process as claimed in claim 1 wherein the position of the focal spot is 50 $\mu$m above the surface to be treated.

3. A process as claimed in claim 1 wherein the pressure of said shield is 36 PSI.

4. A process as claimed in claim 1 wherein the nozzle and the component are maintained at a distance between 10 to 25 mm.

5. A process as claimed in claim 1 wherein said component is kept at an angle with respect to the laser beam.

6. A process as claimed in claim 1 in wherein the inert gas is argon.

7. A process as claimed in claim 6 wherein the nozzle and the component are maintained at a distance between 10 to 25 mm.

8. A process as claimed in claim 7 wherein the position of the focal spot is 50 $\mu$m above the surface to be treated.

9. A process as claimed in claim 8 wherein the pressure of said shield is 36 PSI.

* * * * *